US006765498B1

(12) United States Patent
Sabatino

(10) Patent No.: US 6,765,498 B1
(45) Date of Patent: Jul. 20, 2004

(54) EMBEDDED DIGITIZATION SYSTEM

(75) Inventor: Anthony Edward Sabatino, Albuquerque, NM (US)

(73) Assignee: Honeywell International Inc., Morristown, NJ (US)

( * ) Notice: Subject to any disclaimer, the term of this patent is extended or adjusted under 35 U.S.C. 154(b) by 414 days.

(21) Appl. No.: 09/590,085

(22) Filed: Jun. 7, 2000

(51) Int. Cl.[7] ..... G08B 21/00

(52) U.S. Cl. ..... 340/945; 340/988; 340/990; 342/13; 342/32; 342/61; 375/219; 370/254; 455/84; 455/140; 455/349; 701/200

(58) Field of Search ..... 340/988, 990, 340/995, 945, 961, 531, 963, 971, 825; 701/207, 213, 200, 208, 1, 37; 342/61, 32, 36, 13; 395/500.43; 375/219, 295, 316; 370/254; 345/1; 455/84, 129, 140, 277.1, 280, 349

(56) References Cited

U.S. PATENT DOCUMENTS

| | | | | | |
|---|---|---|---|---|---|
| 5,117,422 | A | * | 5/1992 | Hauptschein et al. | 370/95.1 |
| 5,691,903 | A | * | 11/1997 | Racette, III | 701/207 |
| 5,719,582 | A | | 2/1998 | Gray | 342/120 |
| 5,798,726 | A | * | 8/1998 | Schuchman et al. | 342/37 |
| 5,883,586 | A | | 3/1999 | Tran et al. | 340/945 |
| 6,002,363 | A | * | 12/1999 | Krasner | 342/357.1 |
| 6,018,625 | A | * | 1/2000 | Hayball et al. | 395/500.43 |
| 6,055,478 | A | * | 4/2000 | Heron | 701/213 |
| 6,072,994 | A | * | 6/2000 | Phillips et al. | 455/84 |
| 6,157,891 | A | * | 12/2000 | Lin | 701/301 |
| 6,262,679 | B1 | * | 7/2001 | Tran | 342/29 |
| 6,411,899 | B2 | * | 6/2002 | Dussell et al. | 701/211 |

OTHER PUBLICATIONS

Fitzgerald, Frank, Mike Kawa and Joseph G. Riter; "Kiowa Warrior Control and Display System Development for Task Force XXI"; Apr. 29, 1997; 11 pages.

* cited by examiner

*Primary Examiner*—Benjamin C. Lee
(74) *Attorney, Agent, or Firm*—Kurt A. Luther

(57) ABSTRACT

An embedded digitization system which enables a military platform to receive, transmit and process a variety of types of information for a variety of purposes. The system includes a mission processing capability, a digital message communications capability, a time and position location and navigation capability, a weapons delivery system aim and shoot capability, a sensor input processing capability, a user interface capability, and an input/output processing capability. The system exchanges information through digital message communications with other systems in a theater of operation. Information exchanged and processed by the system includes command and control information, situational information, intelligence information, mission information and host platform information. The system processes information received from digital messages, received from functions and sensors embedded in the present system, received from other equipment and sensors on the host platform, and entered through user data entry devices by users of the system. The system determines the geospatial attitude, position, and motion of the host platform, determines the attitude of moveable weapons delivery systems on the host platform, and determines the geospatial position and motion of a target with additional information from target tracking equipment. The system automatically aims and shoots weapons delivery systems, and provides visual aids which allow users of the system to manually aim and shoot weapons delivery systems associated with the host platform. The system is implemented in as few as one piece of electronics equipment.

22 Claims, 4 Drawing Sheets

Embedded Digitization System 100

Embedded Digitization Software 400

EMBEDDED DIGITIZATION SYSTEM

BACKGROUND OF THE INVENTION

1. Field of the Invention (Technical Field)

The invention relates to the field of digitization equipment for military platforms and more particularly to a method and apparatus for an embedded digitization system that reduces or eliminates the multiplicity of physical elements within the digitization equipment.

2. Background Art

Relevant activities in the field are being carried out by the United States Army and its contractors in an effort to "digitize the Army," which is an effort to integrate digital message communications with existing and new Army platforms. Digital message communications occur within a theatre of operation over wire and wireless local area networks joined through wireless wide area networking, creating a "tactical Internet." The concept of military platforms interacting through digital message communications within a tactical internet, which spans a theatre of operation, is referred to as the "digital battlefield." The problems with the existing systems are functional problems encountered, whether mechanical, electrical, thermal, labor required, performance sought, etc. In addition, each platform usually has its own separate mission processors, time and position location/navigation processors, modem processors, and radio communications devices, making these elements redundant. The use of the prior art redundancy of elements increases the cost and weight of the system and decreases the reliability of the entire system.

The state of the art includes the integration of multiple pieces of equipment, referred to as "digitization equipment," onto a military platform to provide the platform with the capabilities required to communicate digital messages on a tactical internet. A military platform with digitization equipment is referred to as a "digitized platform." Each piece of digitization equipment on the digitized platform provides a unique portion of the required digital communications capabilities. However, each piece of digitization equipment typically includes similar physical elements like processing resources, memory resources, power supplies, communications devices, enclosures and physical interfaces. Thus digitization equipment include a multiplicity of similar physical elements. The disadvantage of the present system is that the cost and weight of digitization equipment is larger than necessary due to multiplicity of physical elements within the digitization equipment.

The present invention solves the problems of the prior art systems by embedding and integrating the capabilities required for digital message communications and mission processing into a system with singular instances of processing resources, memory resources, power supplies, communications devices, enclosures and physical interfaces.

The OH-58D Kiowa Warrior platform digitization equipment is an example of one of these prior art systems. Digitization equipment for this platform include a multiplicity of similar physical elements within its mission processors, time and position location/navigation processor, modem processor, and radio communications devices.

A related technology is embodied in U.S. Pat. No. 5,883,586 Embedded Mission Avionics Data Link System. Whereas the referenced patent describes the embedding of digitization equipment into a platform with multiplicity of similar physical elements, the present invention describes embedding of digitization equipment into singular instances of physical elements.

SUMMARY OF THE INVENTION (DISCLOSURE OF THE INVENTION)

Disclosed herein is an embedded digitization system with a single source for communicating within a platform and with other platforms, thereby eliminating the multiplicity of physical elements in the various devices. The preferred embedded digitization apparatus for integrating digital message communications with at least one platform comprises a single source for sending and receiving digital messages comprising exchanging information between predetermined platform applications. The preferred single source comprises a processor module. The single source can further comprise a configurable radio module, a time and position module, mass memory module and an input/output module. The preferred predetermined applications comprise at least one mission application, a time, position and navigation application, a digital messaging application, at least one weapon application and a user interface application.

In another embodiment, disclosed is a single embedded digitization apparatus for integrating digital message communications with at least one platform comprising a processor module, a time and position module, and a configurable radio module. The preferred time and position module comprises an inertial navigation sensor module and can also comprise a global positioning system (GPS) receiver. The preferred inertial navigation sensor module comprises an apparatus for detecting an angular position and rate of change of the angular position about its three Cartesian axes and detecting acceleration along its Cartesian axes. The aforementioned modules can comprise a single module. The preferred apparatus can further comprise an input/output module. The input and output module can comprise a general purpose interface module comprising at least one output interface for a display, at least one input interface for a point and click apparatus and interfaces for predetermined associated equipment. The associated equipment comprises radios, antennae, weapons delivery systems, at least one user output, at least one user input and at least one sensor. The configurable radio transmission module comprises software controlled communication protocols. The software controlled communication protocols comprise physical layer protocols, data link layer protocols, network layer protocols, transport layer protocols, modulation protocols, waveform protocols, transmission security protocols and communication security protocols.

Also disclosed is an apparatus for sending and receiving digital messages between military platforms comprising a single processing resource, a single memory resource, a single power supply and a single communication resource.

The preferred method for communication digital information from a single source in at least one platform comprises the steps of communicating with a predetermined application and exchanging specific digital information from the communication between a digital messaging application and at least one specific application. The step of exchanging comprises transmitting the specific digital information. The step of exchanging also comprises extracting the specific digital information from the at least one specific application and creating a specific digital message and transmitting the specific digital message. The step of exchanging comprises receiving the specific digital information. The step of exchanging also comprises extracting the specific digital information from at least one digital message. The preferred method further comprises the step of providing the extracted digital information to the at least one specific application. The digital message can also comprise an external source.

The primary objects of the present invention are to enable a military platform to receive, transmit and process a variety of types of information for a variety of purposes. This information is exchanged between digitized platforms and other systems over a tactical internet.

The primary advantages of the present invention are that cost and weight of digitization equipment for digitized platforms are reduced while the reliability of digitization equipment is increased. These advantages are realized because as few as one piece of equipment can provide all digitization equipment capabilities for a digitized platform.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
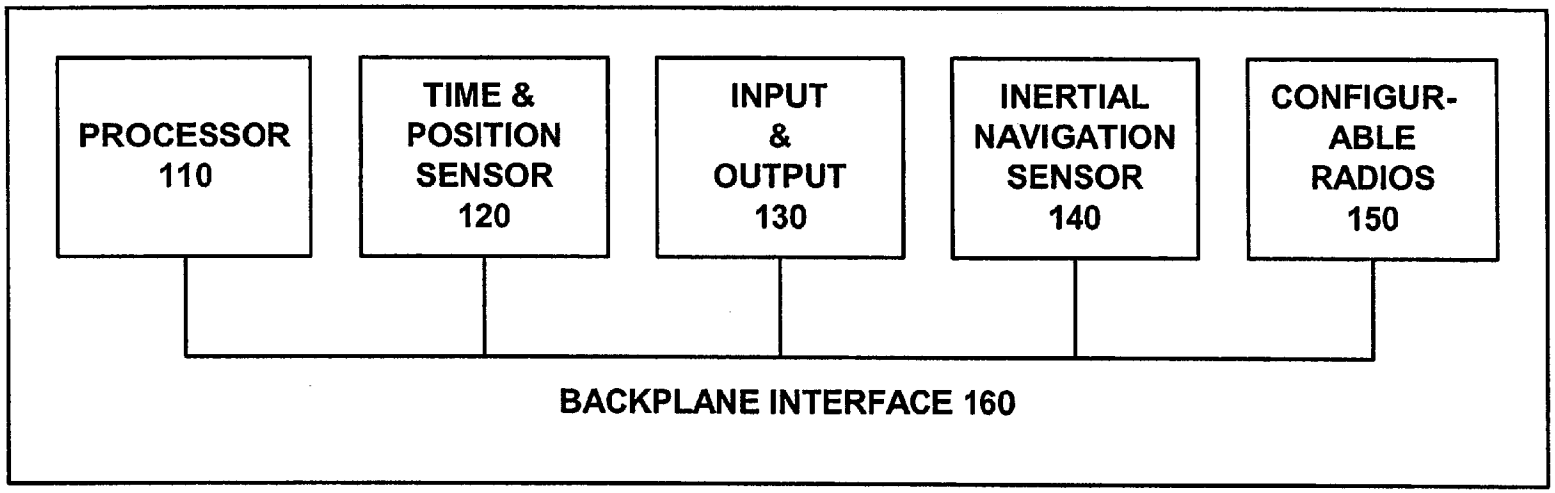
FIG. 1 is a block diagram of the preferred digitized platform.

The present invention provides an apparatus, system, and method for an embedded digitization system. Disclosed in FIG. 1 is a block diagram of a digitized platform 300. The system includes the invention which is an embedded digitization system (EMBEDDED DIGITIZATION SYSTEM) 100 which enables the system to receive, transmit, and process a variety of types of information for a variety of purposes. The system also includes associated equipment and systems (ASSOCIATED EQUIPMENT) 200 which is controlled by the invention and enables the system to perform functions in addition to those directly performed by the invention.

In the preferred embodiment of the invention as shown in FIG. 1, a single instance each of processor module 110, time and position sensor module 120, input and output module 130, inertial navigation sensor module 140 and configurable radio module 150 are embedded in the invention to minimize the cost and weight of the invention while increasing the reliability of the invention. For digitized platforms 300 which do not require highly accurate attitude, position, and motion information, inertial navigation sensor 140 may be removed to further reduce cost and weight of the invention. For digitized platforms 300 with minimal input and output interface requirements, input and output module 130 may be combined with other modules in the invention to reduce cost and weight of the invention.

Figure 2:
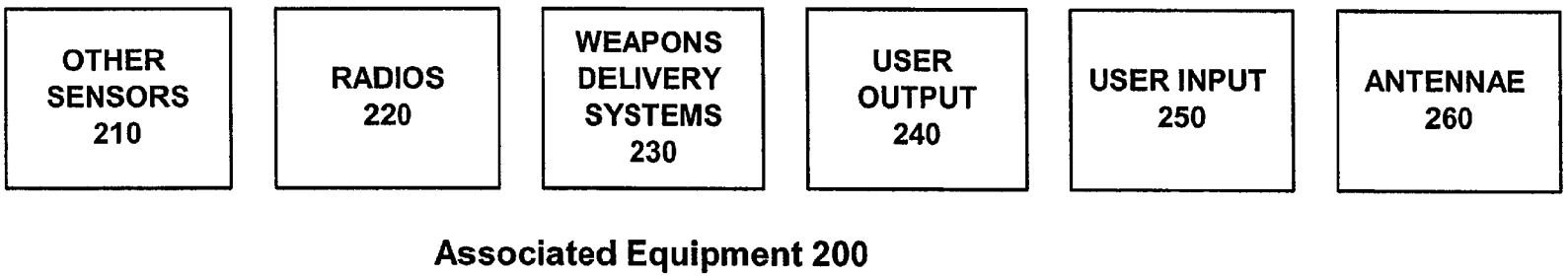
FIG. 2 is a block diagram of the preferred embedded digitization system.

Disclosed in FIG. 2 is a block diagram of the invention, an embedded digitization system 100. Embedded in the invention is one or more processor modules (PROCESSOR) 110 which process all information for the system, a time and position sensor module (TIME & POSITION SENSOR) 120 which senses time and the geospatial position and direction of the invention, one or more input and output modules (INPUT & OUTPUT) 130 which provide interfaces between the invention and other associated equipment and systems, an inertial navigation sensor (INERTIAL NAVIGATION SENSOR) 140 which senses the geospatial attitude, position, and motion of the invention, configurable radio modules (CONFIGURABLE RADIOS) 150 which enable the system to transmit and receive information, an inter-module interface (INTERMODULE INTERFACE) 160 which provides a means for modules and sensors in the invention to share information with each other, and external interfaces (EXTERNAL INTERFACES) 170 which provides a means for the invention to share information with other systems and sub-systems.

In FIG. 2, processor module 110 is a general purpose processor with program memory, general purpose memory, a clock, and timers; time and position sensor module 120 is a global positioning system (GPS) receiver; input and output module 130 is a general purpose interface module which includes output interfaces for a display, input interfaces for a computer mouse (point and click device), and other interfaces for other associated equipment 200; inertial navigation sensor module 140 detects the angular position and rate of change of the angular position about its three Cartesian axes and detects acceleration along its Cartesian axes; configurable radio module 150 is a radio capable of transmitting and receiving on software controlled radio frequencies using communication protocols implemented in software including physical layer protocols, data link layer protocols, network layer protocols, and transport layer protocols, where layers are defined by the open systems interconnection (OSI) model and protocols are defined by a tactical internet; inter-module interface 160 is a high speed interface like IEEE-1394; external interfaces 170 are interfaces to associated equipment 200.

Figure 3:
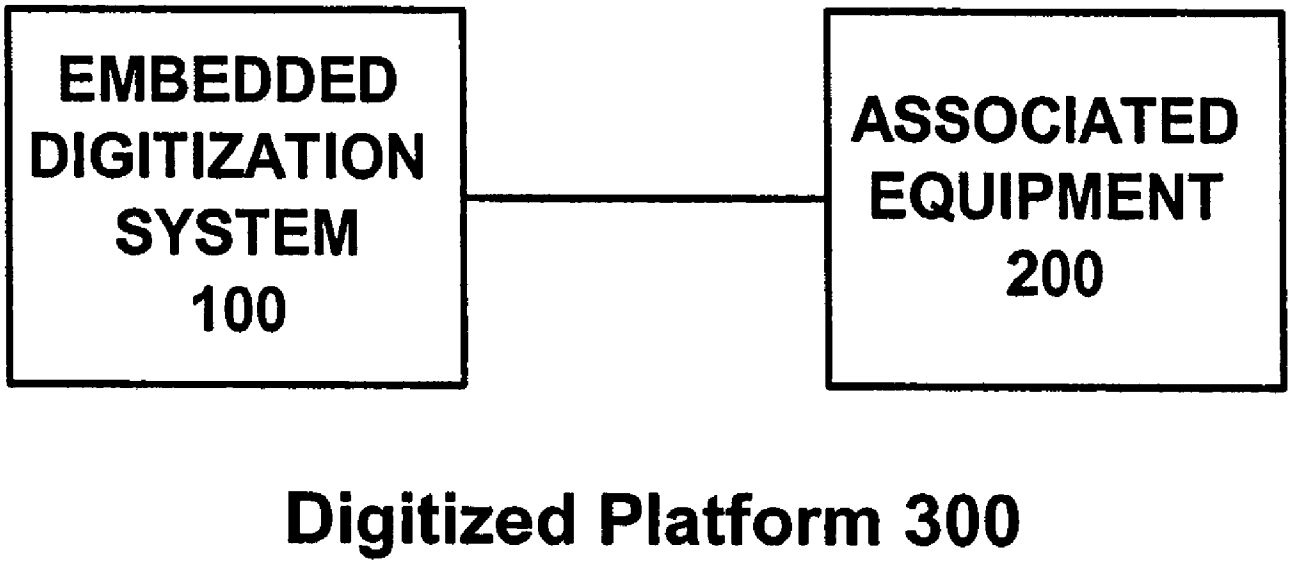
FIG. 3 is a block diagram of typical associated equipment used with the preferred invention.

FIG. 3 is a block diagram of the associated equipment and systems 200. Included in associated equipment and systems are radios (RADIOS) 220 which enable the system to transmit and receive information, antennae (ANTENNAE) 260 for the radios in the system, weapons delivery systems (WEAPONS DELIVERY SYSTEMS) 230 which enable the system to deliver weapons to targets, user output devices (USER OUTPUT) 240 which provide users of the system with visual information regarding the state of the system and its surroundings, user input devices (USER INPUT) 250 which provide users of the system with a means for entering information into the system and controlling the system, and sensors (OTHER SENSORS) 210 which enable the system to sense information in addition to that sensed by the invention in the system or received by the radios in the system or entered by the users of the system.

Figure 4:
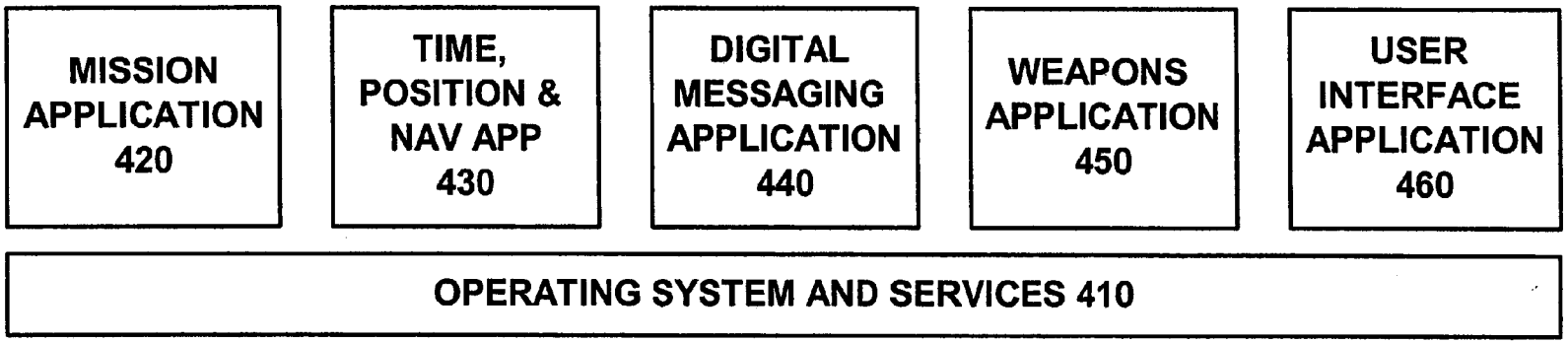
FIG. 4 is a block diagram of the preferred embedded digitization software.

FIG. 4 is a block diagram of the embedded digitization software (EMBEDDED DIGITIZATION SOFTWARE) 400 which is executed by the processor or processors 110. The mission application (MISSION APPLICATION) 420 carries out the following tasks:

provides system functions and services for the invention;

uses information provided by other applications in the invention;

controls other applications in the invention;

uses information provided by modules in the invention;

controls hardware in the invention;

uses information provided by associated equipment 200 on the digitized platform 300;

controls associated equipment 200 on the digitized platform 300;

performs built in tests of the invention;

provides functions and services unique to the digitized platform 300; and performs other tasks as required.

Also disclosed in FIG. 4 is a user interface application (USER INTERFACE APPLICATION) 460 which provides the graphics, text, other visual or audible enunciation, and functions for a user interface. The user interface application 460 is optional in the invention, enabling the invention to be used as an autonomous system or on unmanned digitized platforms 300. The user interface application 460 supports user input 250 like keyboards, pointing devices, switches, touch-screens, head-tracking sensors, eye-tracking sensors, other sensors, interfaces to other applications in the invention, and other input devices. The user interface application 460 supports user output 240 like displays, communication devices, lights, sound devices, interfaces to other applications in the invention, and other output devices.

FIG. 4 also shows a time and position and attitude and navigation application (TIME, POSITION & NAV APP) 430 which computes the time, attitude, position, and motion solution for the digitized platform 300. The time and position and attitude and navigation application 430 uses information from the time and position sensor module 120, input and output module 130, and inertial navigation sensor module 140. When information from time and position sensor module 120 or inertial navigation sensor module 140 is degraded or lost, time and position and attitude and navigation application 430 can continue to periodically compute a time, attitude, position, and motion solution for the digitized platform 300 with graceful degradation in time, attitude, position, and motion solution accuracy.

A digital messaging application (DIGITAL MESSAGING APPLICATION) 440 which extracts information from digital messages received from a tactical internet, extracts information from digitization software 400 and puts the extracted information into digital messages to be transmitted on a tactical internet, processes information associated with received and transmitted digital messages, and implements communications protocols associated with a tactical internet is shown in FIG. 4. Also shown is a weapons application (WEAPONS APPLICATION) 450 which processes information associated with weapons delivery systems 230, and controls weapons delivery systems 230.

FIG. 4 also shows an operating system and services (OPERATING SYSTEM AND SERVICES) 410 which provide services and functions in support of the applications in the invention. Services and functions in the operating system and services 410 include memory protection, scheduling, process control, interfaces to hardware, and other services and functions for embedded software.

Modules could be combined in a number of ways, including into a single module. Processor module 110 can include a single processor or multiple processors on a single or multiple modules. Time and position sensor module 120 is optional, as not all digitized platforms 300 require time and/or geospatial position and/or direction determination. Input and output module 130 is optional, as interfaces can be included on other modules in the invention. Inertial navigation sensor module 140 is optional, as not all digitized platforms 300 require geospatial attitude, position, and motion determination. Configurable radios module 150 is optional, as some digitized platforms 300 have legacy and/or external radios or communicate over interfaces other than radio interfaces. Other modules can be added to the invention to extend the capabilities of the invention and/or enhance the performance of the invention. The time and position and navigation application is 430 optional, as a digitized platform 300 may not have a time and position sensor module 120 and/or a inertial navigation sensor module 140. The weapons application 450 is optional, as a digitized platform 300 may not be a weapons platform or may have legacy or alternate means for controlling its weapons. The user interface application 460 is optional, as a digitized platform 300 may have a legacy or alternate means for providing a user interface, or a digitized platform 300 may require autonomous digitization equipment.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An embedded digitization apparatus for integrating digital message communications onto a first platform, the apparatus comprising;

at least two predetermined platform applications, said at least two predetermined platform applications comprising at least a communications application and a mission processing application;

an interface apparatus for providing a means for sharing the digital message communications between the first platform and at least one external platform;

a single source for sending and receiving the digital message communications between the first platform and said at least one external platform; and said single source also for exchanging the digital message communications between said at least two predetermined platform applications.

2. The invention of claim 1 wherein said single source comprises a processor module.

3. The invention of claim 2 wherein said single source further comprises a configurable radio module.

4. The invention of claim 3 wherein said configurable radio module comprises software controlled communication protocols.

5. The invention of claim 4 wherein said software controlled communication protocols comprise physical layer protocols, data link layer protocols, network layer protocols, transport layer protocols, modulation protocols, waveform protocols, transmission security protocols and communication security protocols.

6. The invention of claim 2 wherein said single source further comprises a time and position module.

7. The invention of claim 6 wherein said time and position module comprises an inertial navigation sensor module.

8. The invention of claim 7 wherein said inertial navigation sensor module comprises an apparatus for detecting an angular position and rate of change of said angular position about its three Cartesian axes and detecting acceleration along its Cartesian axes.

9. The invention of claim 6 wherein said time and position sensor module comprises a global positioning system (GPS) receiver.

10. The invention of claim 2 wherein said single source further comprises a mass memory module.

11. The invention of claim 2 wherein said single source further comprises an input/output module.

12. The invention of claim 11 wherein said input/output module comprises said interface apparatus comprising:

at least one output interface for a display;

at least one input interface for a point and click apparatus; and interfaces for predetermined associated equipment.

13. The invention of claim 12 wherein said associated equipment comprises radios, antennae, weapons delivery systems, at least one user output, at least one user input and at least one sensor.

14. The invention of claim 1 wherein said at least two predetermined platform applications further comprise a time, position and navigation application, a digital messaging application, at least one weapon application and a user interface application.

15. An apparatus for sending and receiving digital information between military platform applications, said military platform applications comprising a communications application and a mission processing application, the apparatus comprising:

a single processing resource;

a single memory resource;

a single power supply;

an interface apparatus for providing a means for sharing the sent and received digital information between said military platform applications; and a single communication resource.

16. A method for exchanging digital information on a first platform, and at least two predetermined platform applications, the at least two predetermined platform applications comprising at least a communications application and a mission processing application, the method comprising the steps of:

a) providing a single source for integrating the digital information for the first platform;

b) formatting the digital information for sharing the digital information with the first platform, the at least two predetermined platforms and at least one external platform;

c) sending and receiving the digital information from the single source with the at least one external platform; and d) exchanging the digital information from the single source at least between the communication application and the mission processing application.

17. The method of claim 16 wherein the step of exchanging comprises transmitting the digital information.

18. The method of claim 16 wherein the step of exchanging comprises extracting the digital information from an application from the at least two predetermined platform applications and creating a specific digital message and transmitting the specific digital message.

19. The method of claim 16 wherein the step of exchanging comprises receiving the digital information.

20. The method of claim 16 wherein the step of exchanging comprises extracting the digital information from at least one digital message.

21. The method of claim 20 further comprising the step of providing the extracted digital information to an application from the at least two predetermined platform applications.

22. The method of claim 20 wherein the digital message comprises an external source.

* * * * *